US006443337B1

(12) United States Patent
Muehlhauser

(10) Patent No.: US 6,443,337 B1
(45) Date of Patent: Sep. 3, 2002

(54) ORNAMENTAL HANGERS

(75) Inventor: Brett Aaron Muehlhauser, Prior Lake, MN (US)

(73) Assignee: Reachables, Inc., Prior Lake, MN (US)

( * ) Notice: Subject to any disclaimer, the term of this patent is extended or adjusted under 35 U.S.C. 154(b) by 0 days.

(21) Appl. No.: 09/656,560

(22) Filed: Sep. 7, 2000

(51) Int. Cl.[7] ..... A47G 25/14
(52) U.S. Cl. ..... 223/85; 223/92
(58) Field of Search ..... 223/85, 92, 88, 223/95; D6/315

(56) References Cited

U.S. PATENT DOCUMENTS

| | | | | | |
|---|---|---|---|---|---|
| 749,455 | A | | 1/1904 | Shoeneman | |
| 924,763 | A | | 6/1909 | Grant | |
| 1,836,968 | A | | 12/1931 | Herzog | |
| D123,389 | S | | 11/1940 | Dunlap | |
| D123,390 | S | | 11/1940 | Dunlap | |
| D123,391 | S | | 11/1940 | Dunlap | |
| D123,392 | S | | 11/1940 | Dunlap | |
| D123,393 | S | | 11/1940 | Dunlap | |
| D123,394 | S | | 11/1940 | Dunlap | |
| D123,395 | S | | 11/1940 | Dunlap | |
| D123,396 | S | | 11/1940 | Dunlap | |
| D123,397 | S | | 11/1940 | Dunlap | |
| D123,398 | S | | 11/1940 | Dunlap | |
| D139,713 | S | | 12/1944 | Rappaport | |
| D140,053 | S | | 1/1945 | Kirsch | |
| D140,054 | S | | 1/1945 | Kirsch | |
| D140,731 | S | | 4/1945 | Kirsch | |
| D140,732 | S | | 4/1945 | Kirsch | |
| D140,733 | S | | 4/1945 | Kirsch | |
| D140,734 | S | | 4/1945 | Kirsch | |
| 2,383,593 | A | | 8/1945 | Deerfsun | |
| D143,826 | S | | 2/1946 | Kirsch | |
| D143,827 | S | | 2/1946 | Kirsch | |
| D143,829 | S | | 2/1946 | Kirsch | |
| D143,830 | S | | 2/1946 | Kirsch | |
| D143,831 | S | | 2/1946 | Kirsch | |
| D145,856 | S | | 10/1946 | Read | |
| D145,857 | S | | 10/1946 | Read | |
| D146,597 | S | | 4/1947 | Dixon | |
| D146,598 | S | | 4/1947 | Dixon | |
| D149,902 | S | | 6/1948 | Petty | |
| D151,404 | S | | 10/1948 | Read | |
| 3,180,544 | A | * | 4/1965 | Magiera | 223/85 |
| 4,364,496 | A | | 12/1982 | Bridgeman | |
| 4,582,233 | A | | 4/1986 | Brickhouse | |
| 4,624,396 | A | * | 11/1986 | Universe | 223/85 |
| D328,394 | S | | 8/1992 | Strickland | |
| 5,201,443 | A | * | 4/1993 | Oswald | 223/85 |
| D354,857 | S | | 1/1995 | Hammer | |
| 5,503,311 | A | * | 4/1996 | Chen | 223/85 |
| 5,538,166 | A | * | 7/1996 | Ogawa et al. | 223/85 |
| 5,557,644 | A | * | 9/1996 | Chen | 223/85 |

* cited by examiner

*Primary Examiner*—Bibhu Mohanty
(74) *Attorney, Agent, or Firm*—Merchant & Gould P.C.

(57) ABSTRACT

The present invention provides an ornamental, elongated hanger for children, relatively shorter people and/or handicapped persons. The hanger includes a hanger body and a hanger neck having a hook at a first end and an elongated neck section attached to the hanger body at a second end. The elongated neck section has at least a portion of an ornamental figure built therein to connect the hanger body. The hanger with such configurations has an attractive appearance and an enhanced strength.

8 Claims, 7 Drawing Sheets

ORNAMENTAL HANGERS

FIELD OF THE INVENTION

The present invention relates to an ornamental hanger. More particularly, this invention relates to an integrally molded ornamental, elongated hanger.

BACKGROUND OF THE INVENTION

Hangers are a commonly used household item. Normally hangers are formed from a single piece of wire and comprise a substantially hollow, triangular portion and a neck portion securely attached to the triangular portion. The triangular portion includes two inclined members and a horizontal member. The neck portion includes a hook and a neck. Items such as garments that are to be hung are positioned on the triangular portion of the hanger and the hook is positioned on a rod or other suitable hanging means that is provided for supporting the hanger.

However, the conventional hangers as described above normally have a short neck. Typically, the total height of a conventional hanger ranges from 6 ½" for children to 9 ½" for adults. Thus, it is inconvenient for children or relatively short people or physically handicapped persons such as wheel chair bound persons to reach the hanger when it is hung from a standard height rod.

Various attempts have been made to provide hangers with ornamental features such as animal figures or the like. However, such ornamental hangers are often not very functional, lack structural strength, and/or do not have sufficient length. Furthermore, many of these design do not lend themselves to low cost and large volume production.

Therefore, there is a need for an improved ornamental hanger that can easily be reached and provide practical utility.

SUMMARY OF THE INVENTION

To overcome the limitations of the related art described above, and to overcome other limitations that will become apparent upon reading and understanding the present specification, this invention is directed to an elongated ornamental hanger with an ornamental figure in the neck.

In one embodiment of the invention, the hanger comprises a hanger body and a hanger neck. The hanger body includes an upper member and a lower member that are connected to form the hanger body with an opening therein. The hanger neck includes a hook section at a first end and an elongated neck section attached to the hanger body at a second end with an ornamental figure built therein.

Still in one embodiment of the invention, the hanger is a one-piece integrally molded structure.

Still in one embodiment of the invention, the ornamental figure is an animal figure. The hook section is a head of the animal figure. The elongated neck section is a neck of the animal figure.

Still in one embodiment of the invention, the ornamental figure of the elongated neck section is connected to the upper member of the hanger body. An opening is present between the upper and lower members for hanging items such as pants. The hanger has added structural integrity due in part to the ornamental figure increasing the width of the neck and hook sections, as well as providing a substantial connection to the upper member of the hanger body.

In an alternative embodiment of the invention, the ornamental figure is connected to the upper and lower members of the hanger body. The hanger has added further additional structural integrity due in part to the ornamental figure connecting the upper and lower members of the hanger body.

Still in one embodiment of the invention, the hanger body is a triangle-shaped body.

Still in one embodiment of the invention, the elongated neck has a cross section shape that is greater in a first direction than in a second direction. Preferably, the cross section shape is generally oval.

In another embodiment of the invention, the hanger comprises a hook section, a hanger body, and an extender. The hanger body includes an upper member and a lower member that are connected to form the hanger body with an opening therein. The extender connects to a portion of the hanger with an ornamental figure built therein, so as to extend a height of the hanger.

Still in another embodiment of the invention, the extender is connected to a neck of the hook section. Preferably, the hanger with the extender is integrally molded in one-piece.

In an alternative embodiment of the invention, the extender is connected to a side portion of the hanger body. Preferably, the hanger with the extender is integrally molded in one-piece.

In an alternative embodiment of the invention, the extender contains an attachment to the hook section or body section of the hanger by a mechanical means that allows a length adjustment of the hanger.

The hanger of the present invention can be easily reached by children or relatively short people or physically handicapped persons, and can increase structural strength. Also, the one-piece integrally molded embodiment can simplify the manufacturing process and reduce the cost, and thus be suitable for large quantity production. The ornamental figure provides a pleasing appearance and adds structural strength to the hanger.

A variety of additional advantages of the invention will be set forth in part in the description which follows, and in part will be obvious from the description, or may be learned by practice of the invention. Various advantages of the invention will be realized and attained by means of the elements and combinations particularly pointed out in the claims. It is to be understood that both the foregoing general description and the following detailed description are exemplary and explanatory only and are not restrictive of the invention as claimed.

DETAILED DESCRIPTION OF THE PREFERRED EMBODIMENT

In the following description of the specific embodiments, reference is made to the accompanying drawings which form a part hereof, and in which is shown by way of illustration the specific embodiments in which the invention may be practiced. It is to be understood that other embodiments may be utilized as structural and/or ornamental changes may be made without departing from the scope of the present invention.

This invention provides an elongated ornamental hanger for children or/and handicapped persons. In one embodiment, the hanger includes a hanger body and a hanger neck having a hook at a first end and an elongated neck section attached to the hanger body at a second end. The elongated neck section has at least a portion of an ornamental figure built therein to connect the hanger body.

Figure 1:
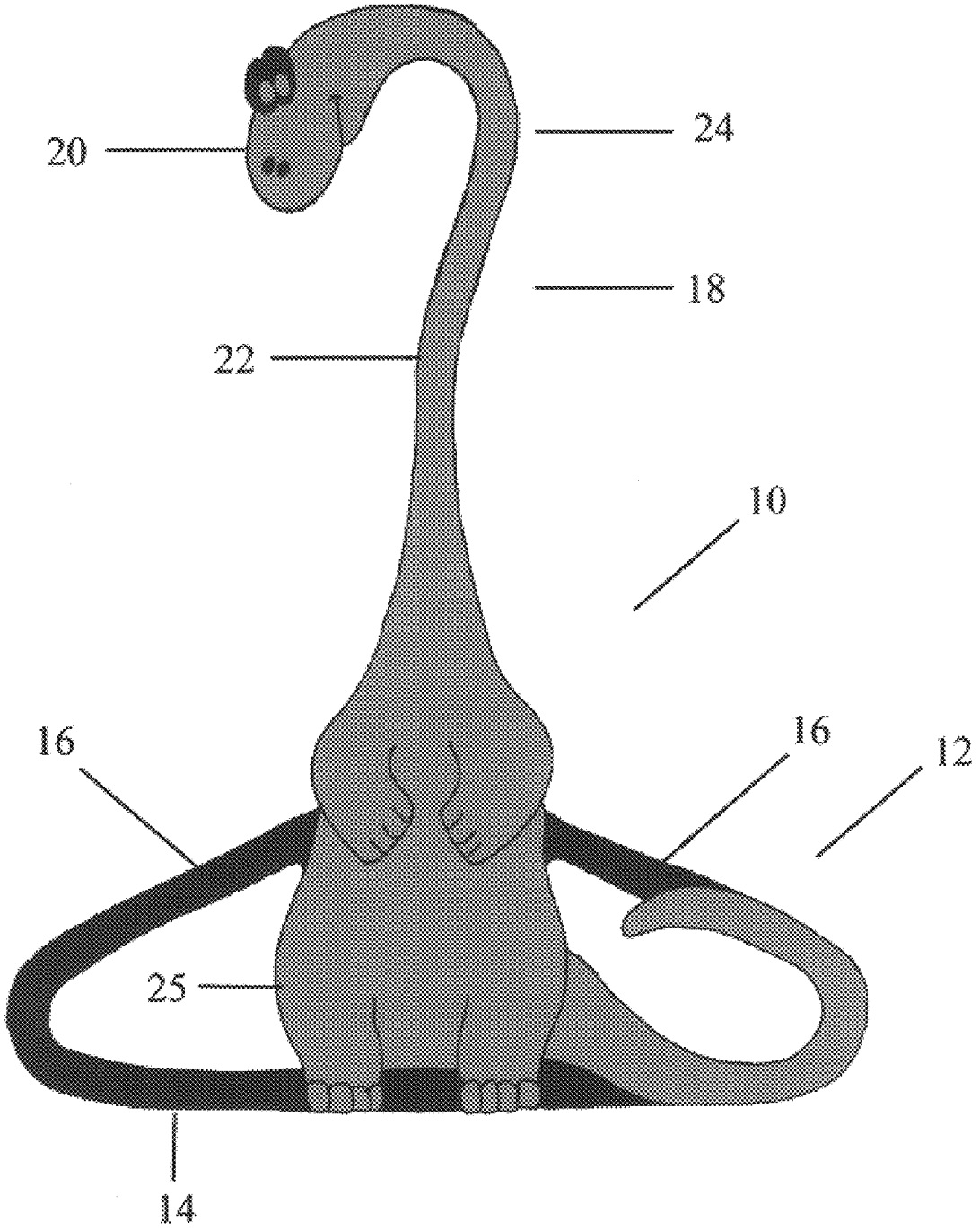
FIG. 1 shows an elongated ornamental hanger according to one embodiment of the present invention with part of an ornamental figure connecting to both upper and lower members of a hanger body of the hanger.
Figure 6:
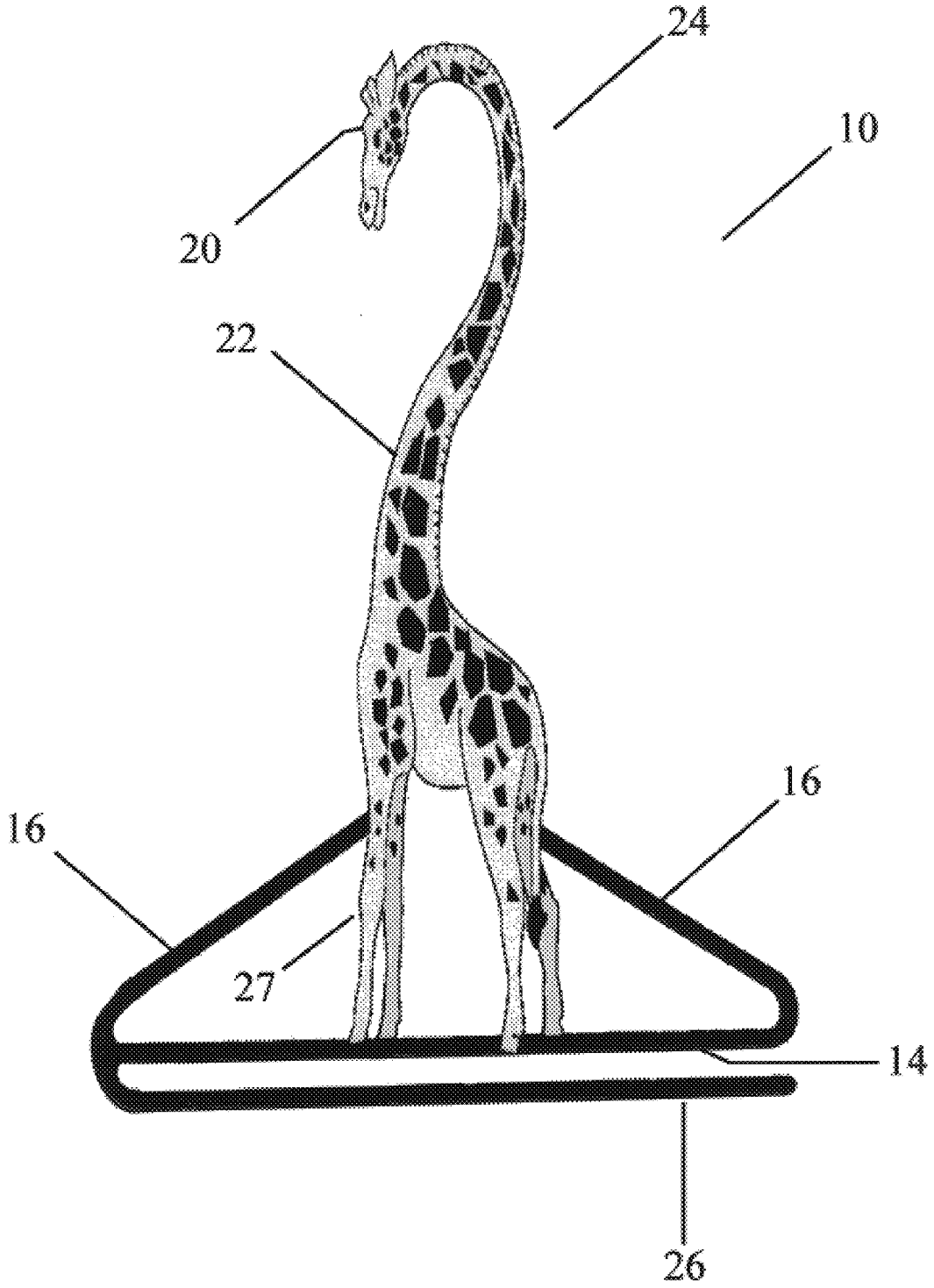
FIG. 6 shows an elongated ornamental hanger according to another embodiment of the present invention having a secondary lower base member.

Referring now to the drawings, FIG. 1 shows an elongated ornamental hanger 10 according to one embodiment of the invention. Preferably, the hanger 10 is a one-piece integrally molded structure made of plastic such as polypropylene plastic. The hanger 10 can be made by injection molding processes, or by other plastic manufacturing processes. The hanger 10 has a generally triangle-shaped hanger body 12 and a hanger neck 18. The hanger body 12 has a base member 14 and two inclined members 16. The hanger neck 18 includes a hook section 20 for hanging on a rod or other suitable hanging means that is provided for supporting the hanger 10, and an elongated neck section 22 attached to the hanger body 12. An ornamental figure such as an animal FIG. 24 is integrally molded as a part of the hanger 10. As shown in FIG. 1, the hook section 20 is a head of the animal FIG. 24, and the elongated neck section 22 is a neck of the animal FIG. 24. A tail of the animal FIG. 24 merges with a portion of the hanger body 12 such as a part of the base member 14 and/or the inclined members 16. A body portion 25 of the animal FIG. 24 connects the inclined members 16 and extends to the base member 14. Thus, the structural strength of the hanger 10 is increased, and the hanger will not be easily broken/deformed. In case skirts/pants need to be hung in such a hanger, clips or the like (not shown) could be provided that are snapped or attached by other means onto the base member 14 for clipping or holding the items, or a secondary lower horizontal base member 26 as shown in FIG. 6 could be provided. In FIG. 6, the hanger 10 has an ornamental figure such as an animal FIG. 24, in which the hook section 20 is a head of the animal FIG. 24, the elongated neck section 22 is neck and body portion of the animal FIG. 24, and legs 27 of the animal FIG. 24 connect the inclined members 16 and extend to the base member 14. Further, the secondary lower base member 26 is provided which is likely open on one end with or without an end support hook or snap for the open end.

Figure 2:
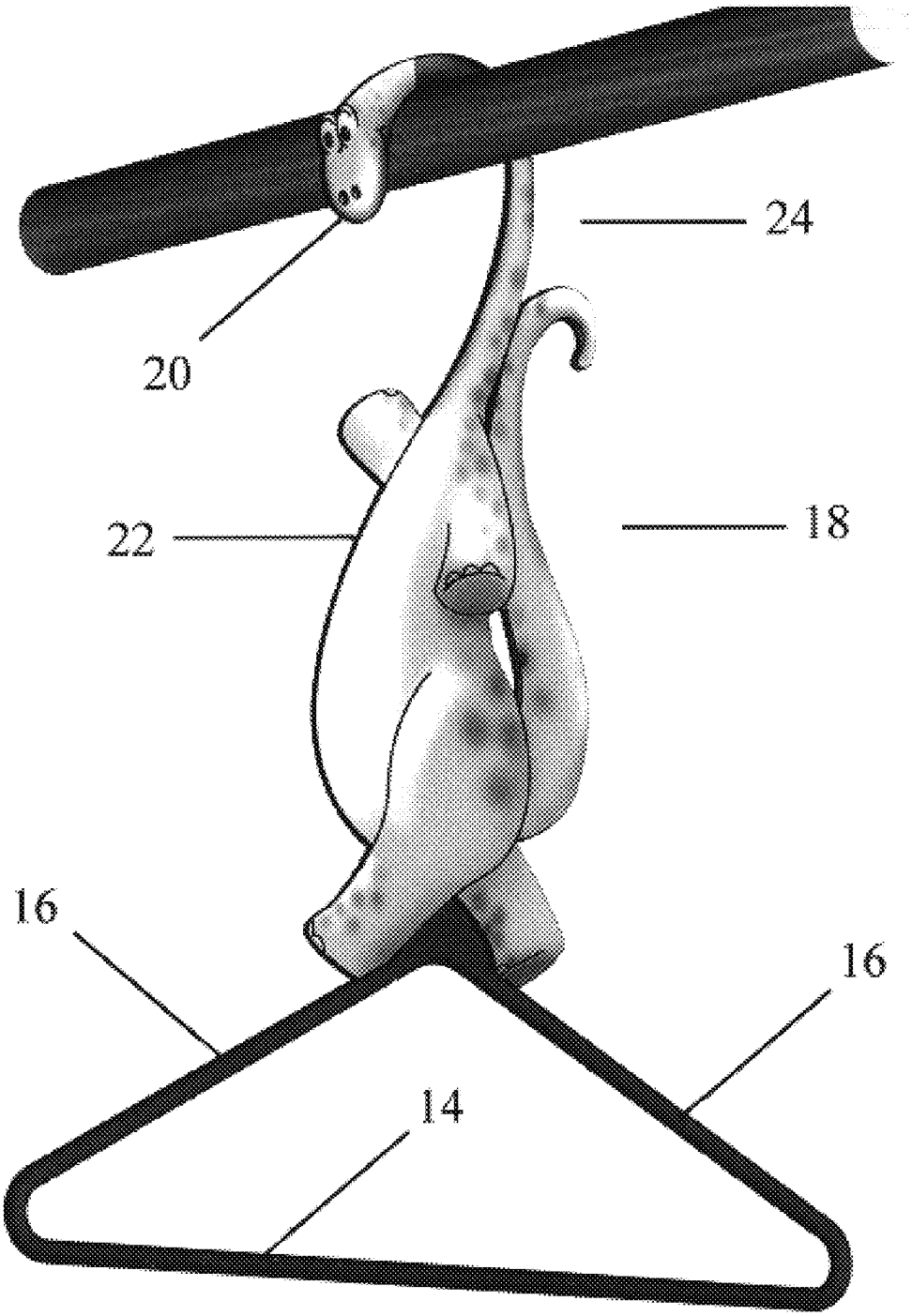
FIG. 2 shows an elongated ornamental hanger according to another embodiment of the present invention with an ornamental figure connecting to upper members of a hanger body of the hanger.

In FIG. 2, there is shown an alternate embodiment of an ornamental hanger in accordance with the principle of the invention, wherein an elongated hanger neck 18 with an animal FIG. 24 built therein connects inclined members 16 and does not connect to a base member 14. The animal FIG. 24 is integrally molded as a part of the hanger 10. An unobstructed opening is thus defined between the base member 14 and the inclined members 16. Accordingly, the items such as pants can be hung on the base member 14. The animal FIG. 24 increases the width of the hanger neck 18 which includes a hook section 20 and a neck section 22, as well as providing a more substantial structural connection to the inclined members 16. Thus, the structural strength of the hanger 10 is increased, and the hanger 10 will not be easily broken or deformed.

It is to be understood that the ornamental figures can be multi-colored and can be three dimensional figures. Raised and/or lowered features could be used to show a three dimensional appearance. Features of the ornamental figures might also be created by painting, dying, printing, insert molding, screening, or other like processes, or by applying features of ornamental figures as a form of coating to the surface of a hanger where the coating has desired features. For example, an adhesive label with an ornamental figure thereon may be applied to the surface of the hanger with or without thermal forming. All of the above processes can be applied to a hanger with a specific figure shape and/or a generic shape having the appearance of multiple figures, animals, etc., to form a single three dimensional shape. The ornamental figures could be of one-piece with the hanger body, or could be a separate part of the hanger body that may be attached mechanically, welded or bonded by other means. The ornamental figures and/or other portions of the hanger may be solid or hollow with a certain design, and with a certain material to provide adequate structural strength.

Figure 3:
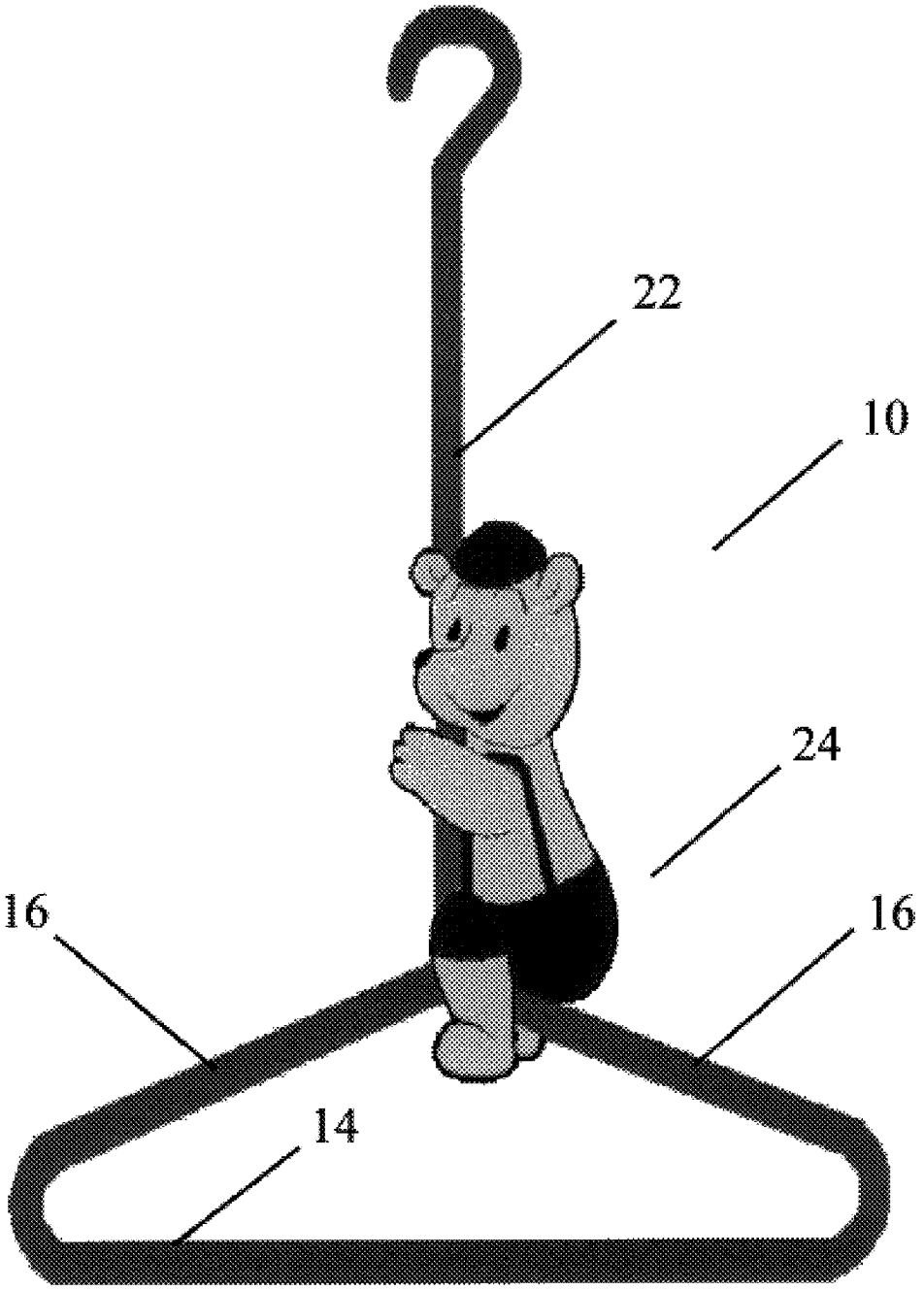
FIG. 3 shows an elongated ornamental hanger according to another embodiment of the present invention with an ornamental figure integrated in part of an elongated neck.
Figure 4:
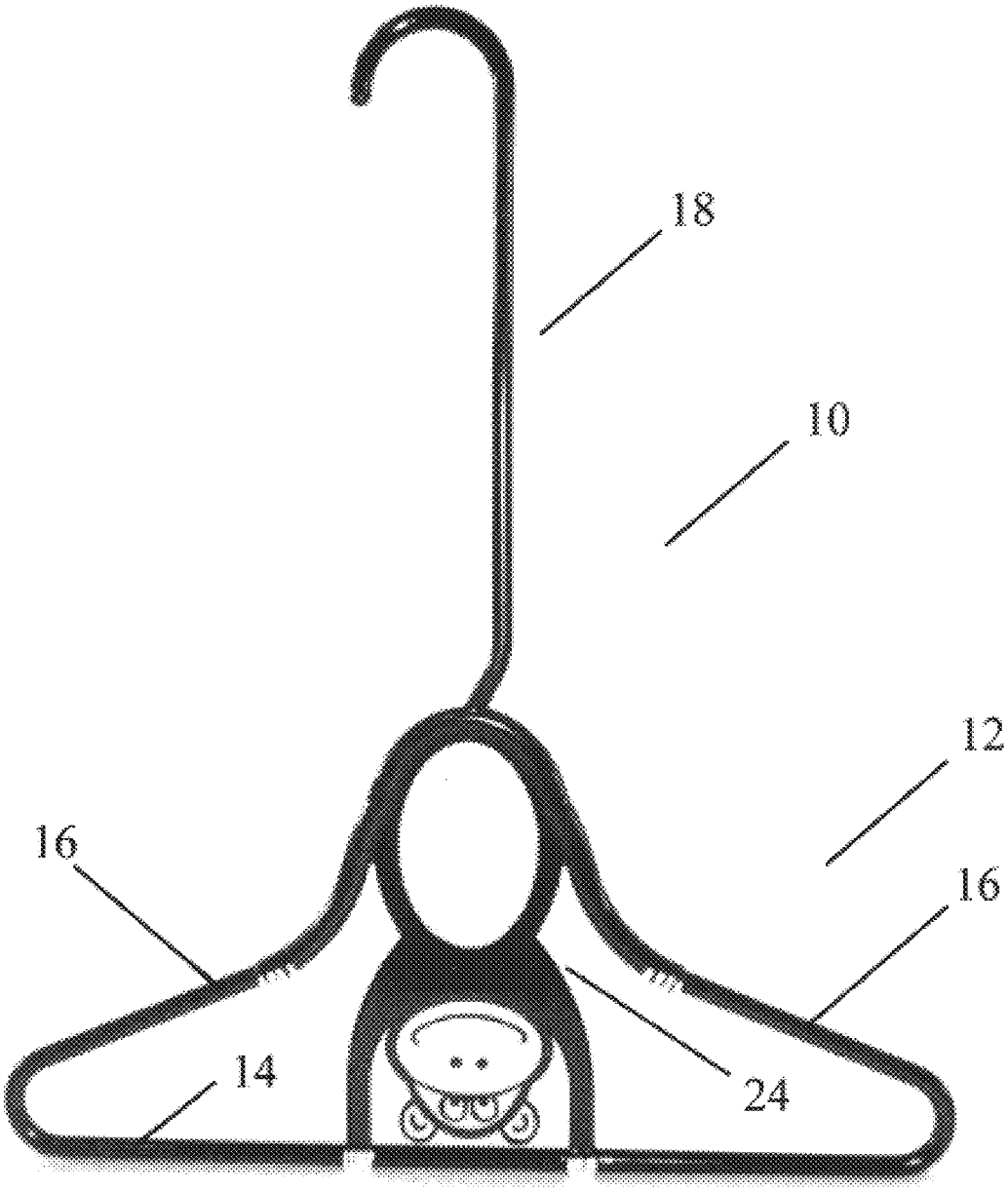
FIG. 4 shows an elongated ornamental hanger according to another embodiment of the present invention with an ornamental figure connecting to both upper and lower members of a hanger body of the hanger.
Figure 5:
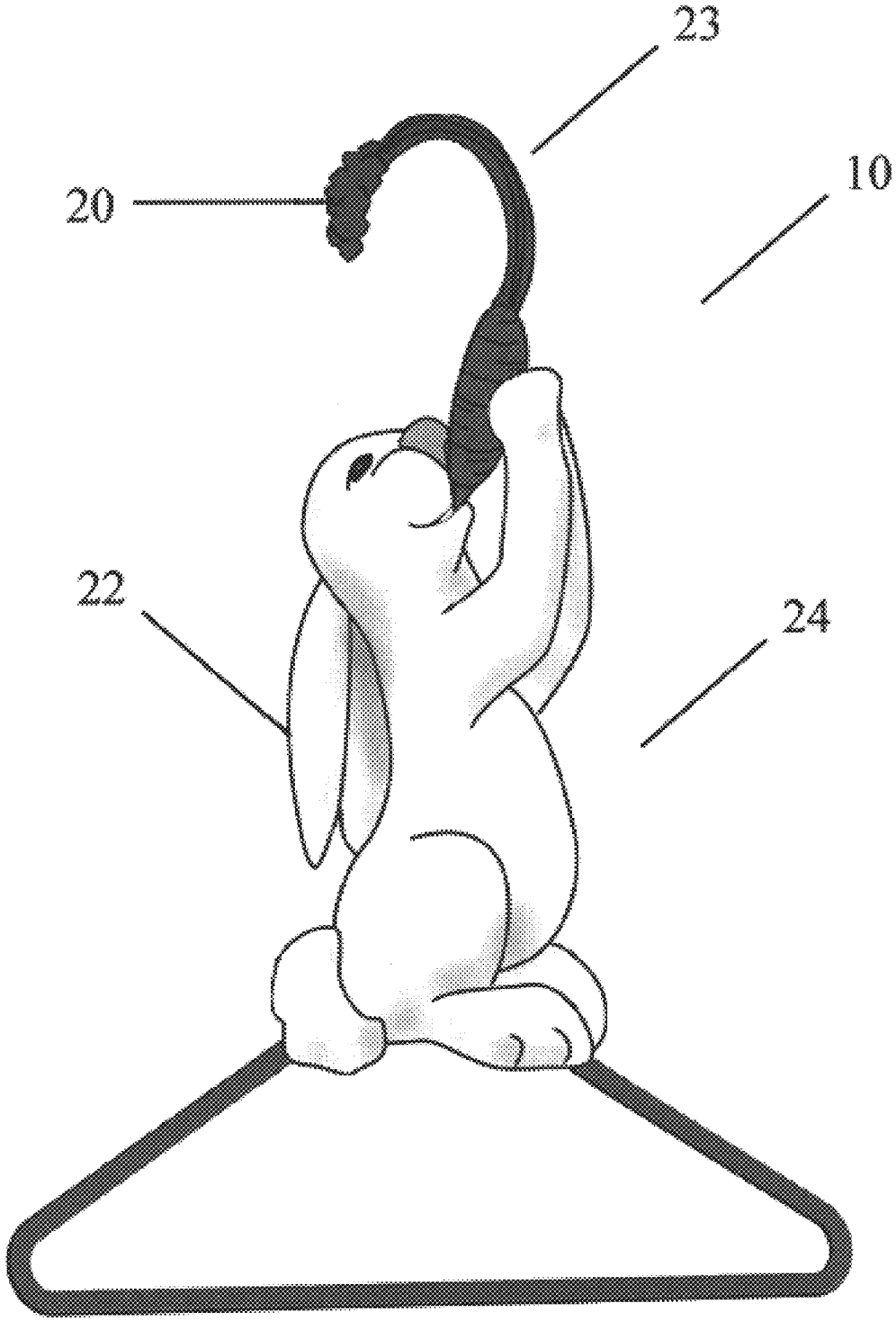
FIG. 5 shows an elongated ornamental hanger according to another embodiment of the present invention with an ornamental figure in a hanger neck of the hanger.

Also, it is to be understood that the figures built into the elongated neck are not limited to a particular animal figure, other ornamental figures such as airplane, cars, cartoon characters, people, nature items or any other type of figures, including a plurality of figures might be present on the hanger. Further, the head of the animal figure is not limited to be positioned in the hook section of the hanger. The animal figure could be positioned any place on the elongated neck or the hanger body. For example, as shown in FIG. 3, an animal FIG. 24 is built in as a part of an elongated neck section 22 of a hanger 10. Also, FIG. 4 shows a hanger 10 that has an animal FIG. 24 with its tail as a main portion of the neck 18. The body of the animal FIG. 24 extends down and attaches to the inclined members 16 and the base member 14 of the hanger body 12. Further, FIG. 5 shows a hanger 10 that has an animal FIG. 24 holding an item 23 upward. The animal FIG. 24 is built as the elongated neck section 22, while the item 23 acts as the hook section 20 of the hanger 10. Furthermore, the shape of the hanger body could be varied rather than limited to be triangular.

Figure 7:
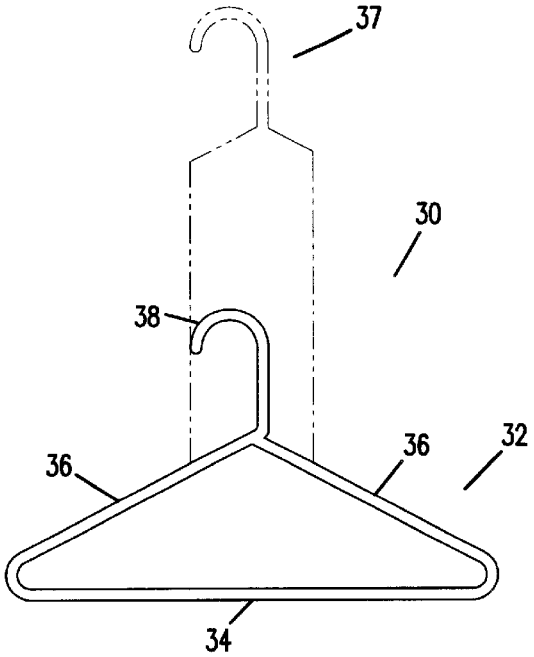
FIG. 7 shows a hanger according to another embodiment of the present invention having an extender connected to a hook section of the hanger. This could include a mechanical means for attachment that allows a length adjustment for the hanger (not shown).
Figure 8:
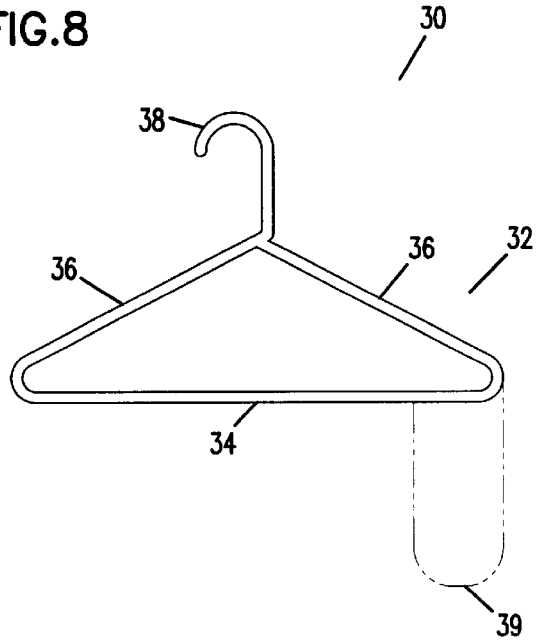
FIG. 8 shows a hanger according to another embodiment of the present invention having an extender connected to a side section of a hanger body. This could include a mechanical means of attachment that allows a length adjustment for the hanger (not shown).

FIGS. 7–8 show hangers 30 according to the alternative embodiments of the present invention. The hanger 30 has a triangle-shaped hanger body 32 including a base member 34 and two inclined members 36, a hook section 38 connected to the hanger body 32, and an extender connected to a portion of the hanger 30. The extender can be a neck extender 37 as shown in FIG. 7, which is attached to the hook section 38 of the hanger 30. Thus, the height of the hanger 30 is increased, and children, relatively short people and/or physically handicapped persons can easily reach the hanger by grabbing a portion of the hanger body 32. Also, the extender can be a base extender 39 as shown in FIG. 8, which is extended downwardly from the side portion of the hanger body 32. With such a structure, the hanger is easily reached by grabbing a portion of the extender 39. In both embodiments, the hanger 30 is suitable for hanging pants.

In the embodiments, the extender could be a separate part which is removably attached to an existing hanger. The hanger and the extender might be a one-piece structure. The extender could attach from side of the hanger, from front of the hanger, from front and back of the hanger, or could include a hollow chamber for the neck extender to attach from the top side by sliding down over the existing hanger hook, or for the base extender to attach from the side by sliding over the existing base member. Variations can be made such as a hanger body with a mating snap as a connector instead of a hook, or a hanger body with a snap connection point for a base extender. Further, either extender could include a mechanical means of attachment that allows a length adjustment of the hanger. The extender could include an ornamental figure such as an animal figure. The figure could be permanently attached to the hanger, or removably attached to the hanger such that the extender can be removed and function as a toy. The hanger and the extender can be made by injection molding processes, or by other plastic manufacturing processes.

Figure 9:
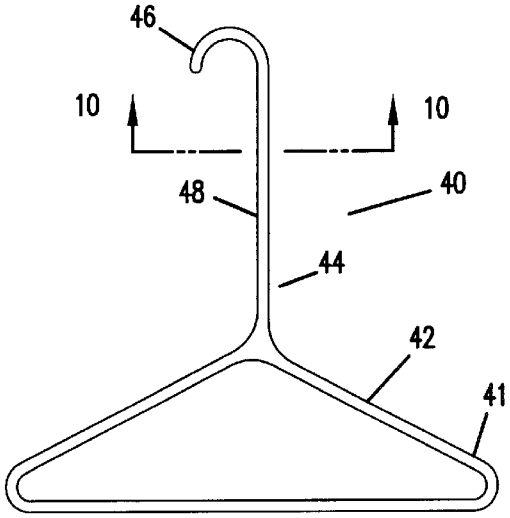
FIG. 9 shows an elongated hanger having an elongated neck according to another embodiment of the present invention.
Figure 10:
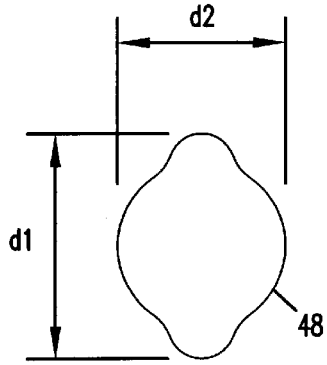
FIG. 10 is an enlarged cross-sectional view of the elongated neck taken at the line 10—10 of FIG. 9.

FIG. 9 shows an elongated hanger 40 according to an alternative embodiment of the present invention. The hanger 40 has a hollow, triangular hanger body 42 and a hanger neck 44. The hanger neck 44 further includes a hook 46 and an elongated neck section 48 attached to the hanger body 42. The cross-sectional view of the neck section 48 as shown in FIG. 10 has a shape which is greater in a first direction d1 than in a second direction d2. That is, the cross section shape of the neck might be more oval rather than circular. Thus, the hanger strength is enhanced. The hanger would not be easily broken when hanging heavy items such as a heavy winter coat. In other embodiments of the invention, the hanger has a substantially circular cross section in non-ornamental figure part. In this embodiment, the overall height of the hanger 40 is approximately 17", and thus to allow children, relatively shorter people and/or physically handicapped persons to reach by grabbing a comer 41 when the hanger is positioned on a standard closet rod. However, the overall height of the hanger could be varied. It is also appreciated that any of the conventional accessories such as clips, etc. could be attached to the hanger.

With the configurations as discussed above, an elongated hanger having an attractive appearance and an enhanced strength can be obtained. Children, relatively shorter people and/or physically handicapped persons are able to reach the hanger when it is positioned on a standard closet rod. The enhanced strength structure also allows to support the heavy clothes. Further, the present invention provides a product with low cost, good quality and high volume in manufacturing.

It is to be understood that the hanger of the present invention might be also used for hanging items such as jewelry or tools other than clothes. The hangers of the present invention may include conventional accessories such as hooks, snaps, clips, rings, etc., either being integral with or attached to the hangers for hanging additional items on the hanger or for attaching to another item. For example, a plastic shoe organizer pouch may be hung from the hanger to make it more accessible. Also, the size of the hanger could be varied. Preferably, the size of the hanger is 14" in width and 17" in height. However, the height of the elongated, ornamental hanger could be various, e.g., the height of the hanger may be 10 ½" or up. Also, the width of the hanger could be wider than a typical adult hanger, so as to fit the wide-shoulder people for avoiding hanger marks in clothing.

It is appreciated that the concept of a hanger with an ornamental figure according to the embodiments of the present invention can be used for a non-extended hanger, and thus to meet the needs of older kids who want a hanger with an ornamental figure (e.g., a cartoon character) but do not need an elongated or extended one. It is also appreciated that the concept of ornamental hanger can be used for a hanger without the base member. Further, the preferred character width is 3", so as to fit into the neck of a small shirt, etc. However, the character width could be varied, e.g., from approximately ½" to 5". For hangers with character width over 5", it would not be practical for hanging pullover shirts, since it would not be easily inserted in the neck hole of a small child's shirt.

The foregoing description of the preferred embodiment of the invention ha been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. An elongated ornamental hanger, comprising:

a hanger body including an upper member and a lower member forming an opening therebetween on the vertical centerline of the hanger; and a hanger neck including a hook section at a first end and an elongated neck section attached to the hanger body at a second end;

the elongated neck section having at least a portion of an ornamental figure built therein; the ornamental figure is connected to the upper member of the hanger body the upper and lower members are connected to form the hanger body with an opening therein the hanger is a one-piece molded structure requiring no assembly.

2. The hanger as claimed in claim 1, wherein the ornamental figure is an animal figure.

3. The hanger as claimed in claim 2, wherein the hook section is a head of the animal figure.

4. The hanger as claimed in claim 2, wherein the elongated neck section is a neck of the animal figure.

5. The hanger as claimed in claim 1, wherein the hanger body is a triangle-shaped hanger body.

6. The hanger as claimed in claim 1, wherein the ornamental figure is a three-dimensional figure.

7. A one-piece elongated hanger having an ornamental figure, comprising:

a hanger body including an upper member and a lower member forming an opening therebetween on the vertical centerline of the hanger;

a hanger neck including a hook section at a first end and an elongated neck section attached to the hanger body at a second end;

the hanger is one piece molded structure requiring no assembly; and at least a portion of the ornamental figure is built into the elongated neck section with a three-dimensional appearance and the ornamental figure is connected to the upper member of the hanger body.

8. The hanger as claimed in claim 7, wherein the hanger body includes two inclined members and a base member, the hanger body being a triangle shape with an opening therein.

* * * * *